United States Patent [19]

Magee, Jr.

[11] Patent Number: 4,814,140

[45] Date of Patent: Mar. 21, 1989

[54] GALLING RESISTANT AUSTENITIC STAINLESS STEEL ALLOY

[75] Inventor: John H. Magee, Jr., Reading, Pa.

[73] Assignee: Carpenter Technology Corporation, Reading, Pa.

[21] Appl. No.: 62,899

[22] Filed: Jun. 16, 1987

[51] Int. Cl.[4] ..... C22C 38/40

[52] U.S. Cl. ..... 420/56; 420/57; 420/58; 420/59; 420/67; 420/65

[58] Field of Search ..... 420/56–59, 420/67, 65, 117

[56] References Cited

U.S. PATENT DOCUMENTS 3,615,365 10/1971 McCunn ..... 420/58
3,912,503 10/1975 Schumacher et al. ..... 420/56

FOREIGN PATENT DOCUMENTS 723362 2/1955 United Kingdom ..... 420/56
2173816A 10/1986 United Kingdom .

*Primary Examiner*—Deborah Yee
*Attorney, Agent, or Firm*—Edgar N. Jay; Vincent T. Pace

[57] ABSTRACT

A galling and corrosion resistant austenitic stainless steel alloy is disclosed containing in weight percent about

| | w/o |
|---|---|
| Carbon | 0.25 Max. |
| Manganese | 2.0–7.0 |
| Silicon | 1.0–5.0 |
| Phosphorus | 0.05 Max. |
| Sulfur | 0.3 Max. |
| Chromium | 12–20 |
| Nickel | 2.0–7.75 |
| Molybdenum | 3 Max. |
| Copper | 3 Max. |
| Nitrogen | 0.35 Max. |

the balance being essentially iron. To attain its unique properties the alloy must be balanced so as to contain no more than about 10% ferrite. The % Ni+$\frac{1}{2}$(% Mn) must not be less than 5.5% and not greater than $\frac{1}{8}$[11(% Si)+42], and the sum of the (% C+% N) is at least 0.15%. Care must be taken that when the amount of silicon present is less than about 2.25%, at least about 4.0% manganese is present.

31 Claims, No Drawings

GALLING RESISTANT AUSTENITIC STAINLESS STEEL ALLOY

BACKGROUND OF THE INVENTION

This invention relates to an austenitic stainless steel alloy, articles made therefrom, and more particularly to such an alloy and articles having improved galling resistance.

Schumacher et al U.S. Pat. No. 3,912,503 (issued Oct. 14, 1975) discloses an austenitic stainless steel alloy there characterized as having excellent galling resistance in wrought form, as well as good wear resistance and corrosion resistance. The alloy as disclosed in that patent consists essentially of about: 10–25 percent by weight (w/o) chromium, 3–15 w/o nickel, 6–16 w/o manganese, 2–7 w/o silicon, 0.001–0.25 w/o carbon, 0.001–0.4 w/o nitrogen, 4 w/o Max. copper, 4 w/o Max. Molybdenum, 0.09 w/o Max phosphorus, 0.25 w/o Max. sulfur, 0.50 w/o Max. selenium and the balance substantially iron. A commercially available example of such a stainless steel is Nitronic 60 (Trademark of Armco Steel Corporation, N.J.) which consists essentially of: 0.10 w/o Max. carbon, 3.50–4.50 w/o silicon, 16.00–18.00 w/o chromium, 7.00–9.00 w/o manganese, 8.00–9.00 w/o nickel, 0.08–0.18 w/o nitrogen and the balance substantially iron. However, there is a need for an austenitic stainless steel alloy with mechanical properties and corrosion resistance properties comparable to those of Nitronic 60 but with even better galling resistance.

SUMMARY OF THE INVENTION

In accordance with this invention, an austenitic stainless steel alloy is provided which has mechanical properties and corrosion resistance properties comparable to Nitronic 60 and improved galling resistance as compared to Nitronic 60. The alloy of this invention consists essentially in weight percent of about:

| | Broad | Intermediate | Preferred |
|---|---|---|---|
| C | 0.25 Max. | 0.02–0.15 | 0.05–0.12 |
| Mn | 2.0–7.0 | 2.5–6.5 | 4.0–6.0 |
| Si | 1.0–5.0 | 2.25–4.5 | 2.75–4.0 |
| Cr | 12–20 | 14–18 | 15.0–17.0 |
| Ni | 2.0–7.75 | 3.5–7.0 | 4.0–6.0 |
| Mo | 3 Max. | 1.5 Max. | 0.75 Max. |
| Cu | 3 Max. | 1.5 Max. | 0.75 Max. |
| N | 0.35 Max. | 0.075–0.25 | 0.10–0.20 |

and the balance of the alloy is essentially iron except for incidental impurities and additions which do not detract from the desired properties. For example, up to about 0.05 w/o, preferably no more than about 0.04 w/o, of each of the elements phosphorus and sulfur; up to about 0.5 w/o, preferably no more than about 0.2 w/o, of each of the elements tungsten, vanadium, columbium and cobalt.

The foregoing tabulation is provided as a convenient summary and is not intended thereby to restrict the lower and upper values of the ranges of the individual elements of the alloy of this invention for use solely in combination with each other or to restrict the broad, intermediate or preferred ranges of the elements for use solely in combination with each other. Thus, one or more of the broad, intermediate and preferred ranges can be used with one or more of the other ranges for the remaining elements. In addition, a broad, intermediate or preferred minimum or maximum for an element can be used with the maximum or minimum for that element from one of the remaining ranges. Throughout this application, unless otherwise indicated, all compositions in percent will be in percent by weight.

In the stainless steel of this invention, silicon, nickel and manganese are critically balanced to provide improved galling resistance and a substantially austenitic microstructure. In this regard, $\%N+\frac{1}{2}(\%Mn)$ must be at least 5.5, preferably at least about 6.0. Because high levels of nickel and manganese in the alloy significantly decrease galling resistance, the $\%Ni+\frac{1}{2}(\%Mn)$ must be no more than about $\frac{1}{8}[11(\%Si)+42]$. And because carbon and nitrogen contribute to the galling resistance of this alloy, the $(\%C+\%N)$ is at least 0.15%. Also, in this alloy, the austenite-forming and the ferrite-forming elements must be balanced so that the alloy in the annealed condition contains no more than 10% ferrite in order to attain its unique galling resistance.

DETAILED DESCRIPTION OF THE INVENTION

Silicon contributes to the galling resistance of the steel of this invention, and at least about 1.0 w/o, preferably at least about 2.25 w/o, is present to provide the outstanding galling resistance characteristic of this alloy. When the silicon content is less than about 2.25 w/o, at least about 4.0 w/o, preferably at least about 5.0 w/o, manganese is present in order to stabilize its austenitic microstructure so that its galling resistance is not reduced by the transformation of its austenite to martensite. However, most of the improvement in galling resistance provided by silicon is obtained with up to about 5.0 w/o silicon. Silicon also acts as a ferrite former and reduces the solubility of nitrogen in the steel of this invention. For these reasons, silicon is limited to about 5.0 w/o, preferably to about 4.5 w/o, thereby making unnecessary larger amounts of nickel and/or manganese to maintain the austenitic balance of the alloy. For best results, about 2.75–4.0 w/o silicon is preferred.

Nickel contributes to the formation of austenite and stabilizes it against transformation to martensite. Nickel also improves the general corrosion resistance of the steel of this invention in acids such as hydrochloric acid and sulfuric acid. For these reasons, at least about 2.0 w/o, preferably at least about 3.5 w/o, nickel is present in the steel. However, because excessive nickel adversely affects the galling resistance of the alloy, nickel is limited to about 7.75 w/o, and for better results to about 7.0 w/o. It is preferred that the alloy contain about 4.0–6.0 w/o nickel.

Manganese increases the solubility of nitrogen in this alloy and also contributes to the desired austenitic structure of the alloy and stabilizes it against transformation to martensite. For these reasons, there is at least about 2.0 w/o, better yet at least about 2.5 w/o, manganese present. Manganese has less of an adverse affect than nickel, about half, on the galling resistance of this composition and, thus, up to about 7.0 w/o manganese is present in this alloy. Better yet, manganese is limited to no more than about 6.5 w/o and for best results manganese is limited to about 4.0–6.0 w/o.

Chromium contributes to the corrosion resistance of this alloy and also to the solubility of nitrogen in the alloy. Therefore, at least about 12%, preferably at least about 14% chromium is present in the steel. Because chromium is a strong ferrite former, it is limited to about 20%, preferably 18%, so that the alloy contains no more than about 10% ferrite. For best results about 15.0–17.0% chromium is present.

In the galling resistant alloy of this invention, up to about 0.25 w/o carbon, including as little as about 0.001–0.005 w/o or less can be present. Carbon beneficially is a strong austenite former and stabilizes it against transformation to martensite. It contributes also to tensile and yield strength. However, the larger amounts of carbon can adversely affect the corrosion resistance and weldability of this alloy. For these reasons, a minimum of about 0.02%, better yet 0.05% and a maximum of about 0.15%, better yet 0.12%, is preferred.

Nitrogen, like carbon, is a strong austenite former and stabilizes it against transformation to martensite. Nitrogen also contributes to the tensile strength and yield strength of the alloy of this invention. Therefore, preferably at least about 0.075% nitrogen is present in this alloy. Nitrogen can be present up to its limit of solubility in this alloy, which may be up to about 0.35%, but for ease of manufacture, the alloy preferably contains no more than about 0.25% nitrogen. For best results this alloy contains about 0.10–0.20% nitrogen.

Both carbon and nitrogen contribute to the galling resistance of this alloy. And in order to attain the improved galling resistance characteristic of this alloy it is necessary that the combined carbon and nitrogen content be at least 0.15%, preferably at least about 0.2%.

Optional elements can be present that contribute to desirable properties. Molybdenum, when present, contributes to the corrosion resistance of this alloy, particularly its chloride pitting resistance and may also improve stress corrosion cracking resistance. Molybdenum also increases the solubility of nitrogen in the alloy. Because excessive molybdenum results in the presence of undesired ferrite, molybdenum is limited to about 3%, preferably to no more than about 1.5%, and better yet to no more than about 0.75%. Copper, when present, also contributes to the corrosion resistance of this alloy, particularly its corrosion resistance to acid environments and is also desirable as an austenite former. Therefore, up to about 3% copper can be beneficial but it is preferred that no more than about 1.5%, better yet no more than about 0.75% be present. If desired, free machining additives, such as about 0.1–0.3% sulfur and/or about 0.25–0.50% selenium can be added to the alloy. A small but effective amount of boron, about 0.0005–0.01% can also be present in this alloy for its beneficial effect on hot workability.

Small amounts of one or more other elements can also be present in the alloy of this invention because of their use during melting in refining (e.g., deoxidizing and/or desulfurizing) the melt and because of other beneficial effects. For example, calcium, magnesium, aluminum, titanium and/or misch metal can be added to the melt to aid in deoxidizing and also to benefit hot workability as measured by high temperature ductility. When added, the amounts of such elements should be adjusted so that the amounts retained in the alloy do not undesirably affect the galling or corrosion resistance or other desired properties of the article. Those elements which if retained in the alloy would tie up carbon and nitrogen are to be added, if at all, only in such quantities that the amount retained in the solidified metal is too little to objectionably impair the desired properties. In the case of such elements as titanium or misch metal (a mixture of rare earths primarily comprising cerium and lanthanum) the retained amount should be no more than about 0.02% and preferably less than about 0.01%.

Within the stated ranges for the various elements, it is necessary to balance the elements C, Mn, Si, Cr, Ni, and N, as well as others when present, so as to limit the amount of ferrite present in the alloy in the annealed condition to no more than about 10% and, for a more fully austenitic composition, preferably to no more than about 5%.

No special techniques are required in melting, casting and working the alloy of this invention. Arc melting with argon-oxygen decarburization is preferred, but other practices can be used. The initial ingot can be cast as an electrode and remelted to enhance homogeneity. Powder metallurgy techniques can also be used if desired. The alloy can be hot worked from a furnace temperature of about 1800–2400 F. (about 980–1315 C.), preferably about 2100–2250 F. (about 1150–1230 C.), with reheating as necessary. Annealing can be carried out at about 1700–2100 F. (about 925–1150 C.), preferably about 1900–2000 F. (about 1040–1095 C.), for a time depending upon the dimensions of the article which is then quenched, preferably in water.

This alloy can be formed into a great variety of shapes for a wide variety of uses and it lends itself to the formation of billets, bars, rod, wire, strip, plate or sheet using conventional practices.

Examples 1–27 of this invention and comparative Heats A-BB, having the analyses set forth in Table I, were induction melted under argon and cast as 2-¾ inch (7.0 cm) square ingots. The ingots were forged to 1-⅛ inch (2.9 cm) square bars from 2200 F. (1200 C.), and the square bars were turned to one inch (2.54 cm) round bars. Galling stress test buttons and blocks were machined from the round bars, annealed at 1950 F. (1065 C.) for one hour and water quenched.

Parallel 0.875 inch (2.2 cm) wide flats were machine ground to provide opposite surfaces on each block, and one of which, the testing surface of each block was ground to have a roughness of 15–40 (Ra) microinches, (Ra being the roughness parameter).

Each buttom was machined to form two tiers with parallel flats forming the opposite end surfaces of the button. The tier forming the testing surface of each button had a reduced diameter of 0.5 inch (1.3 cm)±0.002 in (±0.051 mm) and a machine ground surface with a roughness of 15–40 (Ra) microinches. A flat was milled on a side of each button for turning the button with a wrench and a centering hole provided in the end of each button opposite its machine-ground testing surface. The machine ground surfaces of each button and block pair were de-burred, then their roughness was measured using a profilometer and recorded.

After the buttons and blocks were cleaned to remove machining oils and metal particles, the threshold galling stress for each example was determined in a Tinius-Olsen Tensile machine as follows. The block made from the example being tested was fixed in a jig below the mandrel of the tensile machine. The button of the same composition was then placed on the block with the test surface of the button against the machined surface of the block. Then the mandrel was lowered so that the tip of the mandrel was tightly secured in the centering hole in the end surface of the button. A compressive load was placed on the button and block resulting in a predetermined compressive stress. The button was then rotated smoothly with a wrench counterclockwise 360°, clockwise 360°, and then counterclockwise 360°. The compressive load was then removed, and the mating surfaces visually examined for galling. If no galling was observed a new button, made from the example, was tested at a higher compressive stress level. Threshold galling stress values were determined to within 1 ksi (thousand pounds per square inch) and, except for about six tests where available material did not permit, duplicate samples were tested to confirm the highest stress level at which no galling occurred for the specimens of a given example or composition. The highest stress (ksi) at which galling did not occur is here defined as the threshold galling stress (TGS).

The results of the self-mated galling resistance tests for the examples are set forth in Table II in which [%Ni+½(%Mn)], ⅛[11(%Si)+42] and TGS (ksi) are listed.

TABLE I*

| Ex./ Heat | C | Mn | Si | Cr | Ni | N |
|---|---|---|---|---|---|---|
| 1 | .099 | 5.90 | 3.99 | 15.84 | 5.19 | .16 |
| 2 | .097 | 5.71 | 4.00 | 16.08 | 6.72 | .13 |
| 3 | .110 | 6.00 | 3.96 | 16.31 | 7.72 | .16 |
| 4 | .099 | 2.99 | 3.50 | 16.22 | 4.46 | .10 |
| 5 | .099 | 3.76 | 3.51 | 16.25 | 4.45 | .11 |
| 6 | .101 | 3.06 | 3.48 | 16.17 | 5.50 | .11 |
| 7 | .102 | 5.09 | 3.49 | 16.02 | 4.52 | .15 |
| 8 | .099 | 3.81 | 3.51 | 18.27 | 5.45 | .15 |
| 9 | .102 | 5.03 | 3.50 | 16.02 | 5.50 | .17 |
| 10 | .103 | 2.04 | 3.28 | 16.15 | 5.07 | .13 |
| 11 | .100 | 2.05 | 3.23 | 16.03 | 6.54 | .12 |
| 12 | .098 | 5.92 | 3.22 | 15.98 | 5.20 | .14 |
| 13 | .092 | 5.83 | 3.23 | 15.98 | 6.79 | .14 |
| 14 | .097 | 4.06 | 2.79 | 15.97 | 3.59 | .14 |
| 15 | .099 | 4.89 | 2.77 | 15.78 | 3.59 | .16 |
| 16 | .093 | 3.08 | 2.75 | 15.87 | 4.60 | .15 |
| 17 | .098 | 3.97 | 2.79 | 15.98 | 4.60 | .15 |
| 18 | .100 | 4.90 | 2.79 | 15.85 | 4.55 | .15 |
| 19 | .103 | 2.03 | 2.48 | 16.13 | 5.07 | .12 |
| 20 | .091 | 2.95 | 2.44 | 18.11 | 4.95 | .15 |
| 21 | .103 | 6.00 | 2.52 | 15.91 | 3.58 | .15 |
| 22 | .102 | 2.01 | 2.46 | 16.13 | 6.51 | .14 |
| 23 | .102 | 5.91 | 2.50 | 16.02 | 5.17 | .17 |
| 24 | .108 | 6.03 | 2.04 | 16.58 | 2.56 | .15 |
| 25 | .110 | 5.96 | 1.92 | 16.06 | 4.92 | .16 |
| 26 | .098 | 5.92 | 1.73 | 15.95 | 3.51 | .17 |
| 27 | .102 | 5.94 | .98 | 15.96 | 3.57 | .16 |
| A | .07 | 8.06 | 4.07 | 16.47 | 8.56 | .11 |
| B | .087 | 8.17 | 4.10 | 16.56 | 8.49 | .13 |
| C | .075 | 5.98 | 3.81 | 16.15 | 10.05 | .14 |
| D | .108 | 8.86 | 3.42 | 16.17 | 5.04 | .18 |
| E | .101 | 12.07 | 3.56 | 16.13 | 3.45 | .25 |
| F | .113 | .47 | 3.46 | 16.17 | 9.31 | .06 |
| G | .093 | 3.02 | 2.74 | 15.85 | 3.54 | .10 |
| H | .104 | 2.00 | 2.38 | 16.10 | 3.60 | .12 |
| I | .102 | 10.02 | 2.52 | 18.18 | 2.03 | .29 |
| J | .100 | 6.04 | 2.49 | 16.15 | 6.67 | .15 |
| K | .108 | 0.56 | 2.02 | 16.51 | 5.06 | .12 |
| L | .109 | 1.92 | 2.05 | 16.63 | 5.09 | .14 |
| M | .106 | 6.06 | 2.02 | 16.53 | 7.64 | .14 |
| N | .067 | 1.92 | 1.97 | 15.95 | 10.06 | .15 |
| O | .106 | 2.05 | 1.72 | 16.16 | 3.53 | .13 |
| P | .097 | .72 | 1.78 | 18.06 | 4.98 | .15 |
| Q | .102 | 2.00 | 1.71 | 16.06 | 5.02 | .13 |
| R | .100 | 1.95 | 1.73 | 16.00 | 6.43 | .15 |
| S | .102 | 5.97 | 1.77 | 16.21 | 5.05 | .17 |
| T | .101 | 5.92 | 1.74 | 16.11 | 6.54 | .15 |
| U | .099 | 2.02 | .98 | 16.09 | 3.48 | .15 |
| V | .101 | 2.04 | 1.00 | 16.30 | 4.99 | .11 |
| W | .101 | 2.05 | 1.00 | 16.19 | 6.47 | .18 |
| X | .107 | 5.94 | 1.00 | 15.99 | 5.00 | .17 |
| Y | .103 | 5.97 | .99 | 16.21 | 6.51 | .17 |
| Z | .108 | 1.89 | .61 | 16.74 | 5.03 | .11 |
| AA | .106 | 5.98 | .58 | 16.08 | 5.07 | .15 |
| BB | .110 | 1.94 | .58 | 16.65 | 7.46 | .16 |

*P and S were each less than .030 w/o, and the balance was essentially Fe.

TABLE II

| Ex./ Heat | Mn | Ni | Si | % Nit % Mn 2 | 11 (% Si) + 42 8 | TGS (ksi) |
|---|---|---|---|---|---|---|
| 1 | 5.90 | 5.19 | 3.99 | 8.1 | 10.7 | >20 |
| 2 | 5.71 | 6.72 | 4.00 | 9.6 | 10.8 | 17 |
| 3 | 6.00 | 7.72 | 3.96 | 10.7 | 10.7 | 14 |
| 4 | 2.99 | 4.46 | 3.50 | 6.0 | 10.1 | 14 |
| 5 | 3.76 | 4.45 | 3.51 | 6.3 | 10.1 | 13 |
| 6 | 3.06 | 5.50 | 3.48 | 7.0 | 10.0 | 12 |
| 7 | 5.09 | 4.52 | 3.49 | 7.1 | 10.0 | >20 |
| 8 | 3.81 | 5.45 | 3.51 | 7.4 | 10.1 | 13 |
| 9 | 5.03 | 5.50 | 3.50 | 8.0 | 10.1 | >20 |
| 10 | 2.04 | 5.07 | 3.28 | 6.1 | 9.8 | 13 |
| 11 | 2.05 | 6.54 | 3.23 | 7.6 | 9.7 | 12 |
| 12 | 5.92 | 5.20 | 3.22 | 8.2 | 9.7 | 15 |
| 13 | 5.83 | 6.79 | 3.23 | 9.7 | 9.7 | 9 |
| 14 | 4.06 | 3.59 | 2.79 | 5.6 | 9.1 | 13 |
| 15 | 4.89 | 3.59 | 2.77 | 6.0 | 9.1 | 14 |
| 16 | 3.08 | 4.60 | 2.75 | 6.1 | 9.0 | 12 |
| 17 | 3.97 | 4.60 | 2.79 | 6.6 | 9.1 | 13 |
| 18 | 4.90 | 4.55 | 2.79 | 7.0 | 9.1 | 12 |
| 19 | 2.03 | 5.07 | 2.48 | 6.1 | 8.7 | 15 |
| 20 | 2.95 | 4.95 | 2.44 | 6.4 | 8.6 | 10 |
| 21 | 6.00 | 3.58 | 2.52 | 6.6 | 8.7 | 10 |
| 22 | 2.01 | 6.51 | 2.46 | 7.5 | 8.6 | 9 |
| 23 | 5.91 | 5.17 | 2.50 | 8.1 | 8.7 | 13 |
| 24 | 6.03 | 2.56 | 2.04 | 5.6 | 8.1 | 10 |
| 25 | 5.96 | 4.92 | 1.92 | 7.9 | 7.9 | 10 |
| 26 | 5.92 | 3.51 | 1.73 | 6.5 | 7.6 | 17 |
| 27 | 5.94 | 3.57 | .98 | 6.5 | 6.6 | 10 |
| A | 8.06 | 8.56 | 4.07 | 12.6 | 10.8 | 8 |
| B | 8.17 | 8.49 | 4.10 | 12.6 | 10.9 | 6 |
| C | 5.98 | 10.05 | 3.81 | 13.0 | 10.5 | 4 |
| D | 8.86 | 5.04 | 3.42 | 9.5 | 10.0 | 8 |
| E | 12.07 | 3.45 | 3.56 | 9.5 | 10.1 | 8 |
| F | .47 | 9.31 | 3.46 | 9.5 | 10.0 | 8 |
| G | 3.02 | 3.54 | 2.74 | 5.1 | 9.0 | 3 |
| H | 2.00 | 3.60 | 2.38 | 4.6 | 8.5 | <1 |
| I | 10.02 | 2.03 | 2.52 | 7.0 | 8.7 | 7 |
| J | 6.04 | 6.67 | 2.49 | 9.7 | 8.7 | 4 |
| K | 0.56 | 5.06 | 2.02 | 5.3 | 8.0 | <1 |
| L | 1.92 | 5.09 | 2.05 | 6.1 | 8.1 | 7 |
| M | 6.06 | 7.64 | 2.02 | 10.7 | 8.0 | <1 |
| N | 1.92 | 10.06 | 1.97 | 11.0 | 8.0 | <1 |
| O | 2.05 | 3.53 | 1.72 | 4.6 | 7.6 | <1 |
| P | 0.72 | 4.98 | 1.78 | 5.3 | 7.7 | 1 |
| Q | 2.00 | 5.02 | 1.71 | 6.0 | 7.6 | 2 |
| R | 1.95 | 6.43 | 1.73 | 7.4 | 7.6 | 8 |
| S | 5.97 | 5.05 | 1.77 | 8.0 | 7.7 | 8 |
| T | 5.92 | 6.54 | 1.74 | 9.5 | 7.6 | 4 |
| U | 2.02 | 3.48 | .98 | 4.5 | 6.6 | <1 |
| V | 2.04 | 4.99 | 1.00 | 6.0 | 6.6 | <1 |
| W | 2.05 | 6.47 | 1.00 | 7.5 | 6.6 | 1 |
| X | 5.94 | 5.00 | 1.00 | 8.0 | 6.6 | 7 |
| Y | 5.97 | 6.51 | .99 | 9.5 | 6.6 | 1 |
| Z | 1.89 | 5.03 | .61 | 6.0 | 6.1 | 1 |
| AA | 5.98 | 5.07 | .58 | 8.1 | 6.0 | 7 |
| BB | 1.94 | 7.46 | .58 | 8.4 | 6.0 | 2 |

The analyses and data set forth in Tables I and II demonstrate the improved galling resistance of Examples 1–27, representative of the present invention. The test specimens of these examples all had threshold galling stress levels 9 ksi or greater. For each of the analyses of Exs. 1–27, the %Ni+½(%Mn) is equal to or greater than 5.5% and equal to or less than ⅛[11(%Si)+42]. On the other hand, in the case of Heats A-BB all specimens had threshold galling stress levels of 8 ksi or less.

The data demonstrate that within the ranges stated herein, to attain the outstanding galling resistance characteristic of the alloy of the present invention, it is necessary to control Mn, Ni and Si so that %Ni+½(%Mn) is not less than 5.5% and not greater than ⅛[11(%Si)+42]. Thus, the 3.02% Mn, 3.54% Ni and 2.74% Si content of Heat G, though well within the ranges specified herein for those elements, provided specimens which had a threshold galling resistance of only 3 ksi, because the %Ni+½(%Mn) is less than 5.5%. Heats H, K, O, P, and U also had insufficient amounts of Ni and/or Mn present so that in each case the %Ni+½(%Mn) is less than 5.5%. Heats A-C, J, M, N, S, T, W-Y, AA and BB though containing sufficient nickel and manganese to satisfy the requirement that %Ni+½(%Mn) be not less than 5.5%, those elements were not balanced in relation to the silicon to ensure that the value of %Ni+½(%Mn) was not greater than ⅛[11(%Si)+42]. Heats L, Q, R, V and Z illustrate the requirement that when the silicon content of this composition is less than about 2.25%, then in addition to satisfying the just stated Ni, Mn and Si relationships it is also necessary that at least about 4.0% manganese be present in order to attain the improved galling resistance characteristic of the alloy of this invention. Heats D, E, F and I illustrate that in addition to the criteria thus far mentioned in this paragraph, it is also essential that the amount of manganese present be carefully controlled in accordance with the present invention.

To further demonstrate the adverse effect on galling resistance when the combined carbon and nitrogen content is less than about 0.15%, Heats CC-EE were prepared as was described in connection with the compositions in Table I. To show the adverse effect of retained additions of cerium, a major component of misch metal, and titanium, Heats FF-JJ were similarly prepared. The analyses of Hts. CC-JJ are set forth in Table III which, for convenient reference, also includes the carbon plus nitrogen content and the threshold galling stress in thousands of pounds per square inch [TGS(ksi)]. In these heats, sulfur and phosphorus were each less than 0.03% and the balance was essentially iron.

TABLE III

| Ht. | C | Mn | Si | Cr | Ni | N | Ce | Ti | % C + % N | TGS ksi |
|---|---|---|---|---|---|---|---|---|---|---|
| CC | .071 | 4.60 | 3.19 | 14.95 | 5.89 | .11 | — | — | .181 | 10 |
| DD | .069 | 4.56 | 3.23 | 14.85 | 5.93 | .012 | — | — | .081 | 5 |
| EE | .069 | 4.58 | 3.19 | 14.88 | 5.89 | .070 | — | — | .139 | 8 |
| FF | .024 | 5.11 | 2.56 | 17.33 | 4.11 | .15 | — | — | .174 | <1 |
| GG | .019 | 5.17 | 2.57 | 17.40 | 4.13 | .16 | .10 | .050 | .179 | 1 |
| HH | .047 | 6.43 | 3.12 | 18.59 | 5.17 | .18 | .26 | .068 | .227 | 5 |
| II | .022 | 5.24 | 2.62 | 17.33 | 4.12 | .21 | .055 | .046 | .232 | 4 |
| JJ | .102 | 6.05 | 2.55 | 16.00 | 5.04 | .16 | .09 | .032 | .262 | 6 |

Heat CC is a further example of the present invention and with Heats DD and EE demonstrate the effect of increasing nitrogen in compositions that are essentially the same except for the intentional variations in nitrogen content. With a combined %C+%N of 0.081% and 0.139%, respectively, Heats DD and EE had TGS values of 5 and 8 respectively, below the minimum TGS value characteristic of the present alloy. Referring to Heat FF, its poor galling resistance was caused by the presence of 15% ferrite in the annealed condition, resulting from the increase in ferrite- and decrease in austenite-forming elements, e.g. Cr and Ni, as compared, for example, to Heat CC. Each of Heats GG-JJ contains excessive amounts of Ce and Ti which significantly decreased galling resistance of the material.

The alloy of the present invention, because of its unique properties, is advantageously used in a wide variety of applications where an austenitic, nonmagnetic stainless steel alloy having outstanding resistance to galling, to wear and to corrosion is required. The present alloy is especially well suited for use where unlubricated parts or articles of austenitic stainless steel are required, as in the food industry, in the form of, for example, pressure valves, valve stems, fasteners, shafts, pins, chain links, conveyor belts, and other articles and parts which make sliding surface-to-surface contact in use with other parts or articles of the same composition. The terms and expressions which have been employed are used as terms of description and not of limitation, and there is not intention in the use of such terms and expressions of excluding any equivalents of the features shown and described or portions thereof, but it is recognized that various modifications are possible within the scope of the invention claimed.

What is claimed is:

1. A galling and corrosion resistant austenitic stainless steel alloy consisting essentially in weight percent of about

| | w/o |
|---|---|
| Carbon | 0.25 Max. |
| Manganese | 2.0–7.0 |
| Silicon | 1.0–5.0 |
| Phosphorus | 0.05 Max. |
| Sulfur | 0.3 Max. |
| Chromium | 12–20 |
| Nickel | 2.0–7.75 |
| Molybdenum | 3 Max. |
| Copper | 3 Max. |
| Nitrogen | 0.35 Max. |

the balance consisting essentially of iron, containing no more than about 10% ferrite, in which %Ni+½(%Mn) is not less then 5.5% and not greater than ⅛{11(%Si)+42}, (%C+%N) is at least 0.15%, and when the amount of silicon present is less than about 2.25% at least about 4.0% manganese is present, said alloy having improved galling resistance as indicated by a minimum threshold galling stress of 9 ksi in the threshold galling stress test described in the foregoing specification.

2. The alloy set forth in claim 1 in which %Ni+½(%Mn) is not less than about 6.0%.

3. The alloy set forth in claim 1 which contains at least about 5.0% manganese when the silicon content is less than about 2.25%.

4. The alloy set forth in claim 1 containing 0.05% Max. sulfur.

5. The alloy set forth in claim 1 containing 0.15% Max. carbon, 0.25% Max. nitrogen, and 0.04% Max. of each of phosphorus and sulfur.

6. The alloy set forth in claim 1 containing at least about 0.2% carbon plus nitrogen.

7. A galling and corrosion resistant austenitic stainless steel alloy consisting essentially in weight percent of about

| | w/o |
|---|---|
| Carbon | 0.25 Max. |
| Manganese | 2.0–7.0 |
| Silicon | 2.25–5.0 |
| Phosphorus | 0.05 Max. |
| Sulfur | 0.3 Max. |
| Chromium | 12–20 |
| Nickel | 2.0–7.75 |
| Molybdenum | 3 Max. |
| Copper | 3 Max. |
| Nitrogen | 0.35 Max. |

the balance consisting essentially of iron, containing no more than about 10% ferrite, in which $\%Ni+\frac{1}{2}(\%Mn)$ is not less than 5.5% and not greater than $\frac{1}{8}[11(\%Si)+42]$, $(\%C+\%N)$ is at least 0.15%, and when the amount of silicon present is less than about 2.25% at least about 4.0% manganese is present, said alloy having improved galling resistance as indicated by a minimum threshold galling stress of 9 ksi in the threshold galling stress test described in the foregoing specification.

8. The alloy set forth in claim 7 containing

| | w/o |
|---|---|
| Carbon | 0.02–0.15 |
| Manganese | 2.5–6.5 |
| Silicon | 2.25–4.5 |
| Phosphorus | 0.04 Max. |
| Sulfur | 0.04 Max. |
| Chromium | 14–18 |
| Nickel | 3.5–7.0 |
| Nitrogen | 0.075–0.25. |

9. The alloy set forth in claim 8 in which $\%Ni+\frac{1}{2}(\%Mn)$ is not less than about 6.0%.

10. The alloy set forth in claim 7 containing

| | w/o |
|---|---|
| Carbon | 0.05–0.12 |
| Manganese | 4.0–6.0 |
| Silicon | 2.75–4.0 |
| Chromium | 15.0–17.0 |
| Nickel | 4.0–6.0 |
| Nitrogen | 0.10–0.20 |

11. The alloy set forth in claim 1 containing less than about 1.5% molybdenum.

12. The alloy set forth in claim 1 containing less than about 1.5% Max. molybdenum and less than about 1.5% copper.

13. The alloy set forth in claim 1 containing no more than about 0.75% Max. molybdenum and no more than about 0.75% Max. copper.

14. The alloy as set forth in claim 8 containing no more than about 1.5% molybdenum and no more than about 1.5% copper.

15. The alloy as set forth in claim 8 containing no more than about 0.75% molybdenum and no more than about 0.75% copper.

16. The alloy as set forth in claim 10 containing no more than about 1.5% molybdenum and no more than about 1.5% copper.

17. The alloy as set forth in claim 10 containing no more than about 0.75% molybdenum and no more than about 0.75% copper.

18. The alloy set forth in claim 7 containing less than about 1.5% molybdenum.

19. The alloy set forth in claim 7 containing less than about 1.5% Max. molybdenum and less than about 1.5% copper.

20. The alloy set forth in claim 7 containing no more than about 0.75% Max. molybdenum and no more than about 0.75% Max. copper.

21. The alloy as set forth in claim 7 containing no more than about 1.5% copper.

22. The alloy as set forth in claim 7 containing no more than about 0.75% molybdenum.

23. The alloy as set forth in claim 7 containing no more than about 0.75% copper.

24. The alloy as set forth in claim 7 containing no more than about 1.5% molybdenum.

25. The alloy as set forth in claim 7 containing no more than about 1.5% copper.

26. The alloy as set forth in claim 7 containing no more than about 0.75% molybdenum.

27. The alloy as set forth in claim 7 containing no more than about 0.75% copper.

28. The alloy as set forth in claim 9 containing no more than about 1.5% molybdenum.

29. The alloy as set forth in claim 9 containing no more than about 1.5% copper.

30. The alloy as set forth in claim 9 containing no more than about 0.75% molybdenum.

31. The alloy as set forth in claim 9 containing no more than about 0.75% copper.

* * * * *

UNITED STATES PATENT AND TRADEMARK OFFICE

CERTIFICATE OF CORRECTION

PATENT NO. : 4,814,140

DATED : March 21, 1989

INVENTOR(S) : John H. Magee, Jr.

It is certified that error appears in the above-identified patent and that said Letters Patent is hereby corrected as shown below:

On the face sheet, Item [58], before "420/", insert -- 428/683; -- and in Item [56], add to the list of U.S. Patent Documents, -- 4,609,577 9/86 Long .....428/683 --; Col. 4, line 43, "buttom" should read -- button --; Col. 6, Table II, the formula over table column 5 should read $\%Ni + \frac{\%Mn}{2}$ and the formula over column 6 of the table should read $\frac{11(\%Si)+42}{8}$ ;Col. 10, lines 33, 35, 37 and 39, for claim reference numeral "7", each occurrence, read -- 8 -- and in lines 41, 43, 45 and 47, for claim reference numeral "9", each occurrence, read -- 10 --.

Signed and Sealed this

Nineteenth Day of December, 1989

*Attest:*

JEFFREY M. SAMUELS

*Attesting Officer* *Acting Commissioner of Patents and Trademarks*